US006022281A

United States Patent [19]

Nolan

[11] Patent Number: 6,022,281

[45] **Date of Patent: *Feb. 8, 2000**

[54] BASEBALL BAT AND PRACTICE DEVICE COMBINATION

[76] Inventor: Timothy J. Nolan, 332 Joren Trail, Antioch, Ill. 60002

[ * ] Notice: This patent is subject to a terminal disclaimer.

[21] Appl. No.: 09/009,040

[22] Filed: Jan. 20, 1998

Related U.S. Application Data

[63] Continuation of application No. 08/580,985, Jan. 3, 1996, Pat. No. 5,741,193.

[51] Int. Cl.[7] ..... A63B 59/06

[52] U.S. Cl. ..... 473/457; 473/519; 473/564

[58] Field of Search ..... 473/457, 564, 473/519, 566, 567

[56] References Cited

U.S. PATENT DOCUMENTS

| | | | |
|---|---|---|---|
| 1,026,990 | 5/1912 | Matson | 473/564 |
| 4,768,785 | 9/1988 | Patterson | 473/457 |
| 5,674,138 | 10/1997 | Nolan | 473/457 |

*Primary Examiner*—Mark S. Graham
*Attorney, Agent, or Firm*—Meroni & Meroni; Charles F. Meroni, Jr.

[57] ABSTRACT

A baseball bat has a knob end disposed at one end of the bat adjacent to a cylindrically shaped handle portion of the bat. The knob end has a socket hole with internal threads in axial alignment with the bat. The practice device includes a weight structure having a weight sized for positioning in coaxial engagement with the knob end of the baseball bat. The weight structure has a bolt threadingly engageable with the internal threads of the socket hole to secure the practice device in fixed assembly with the knob end of the baseball bat for use in training.

14 Claims, 3 Drawing Sheets

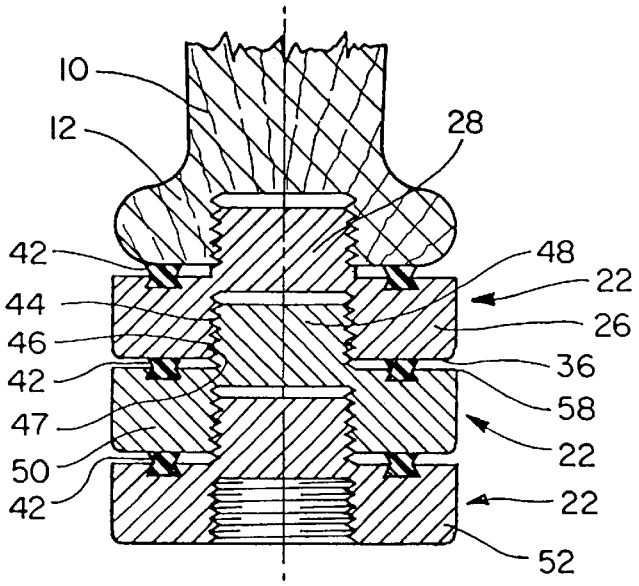
Fig. 4
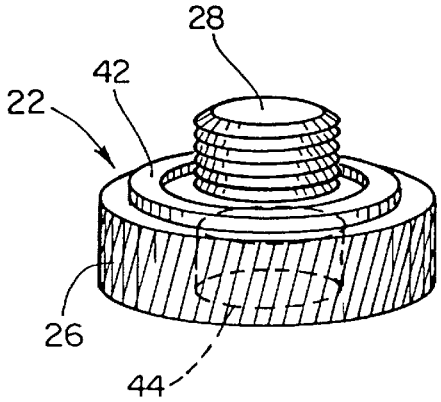
Fig. 5
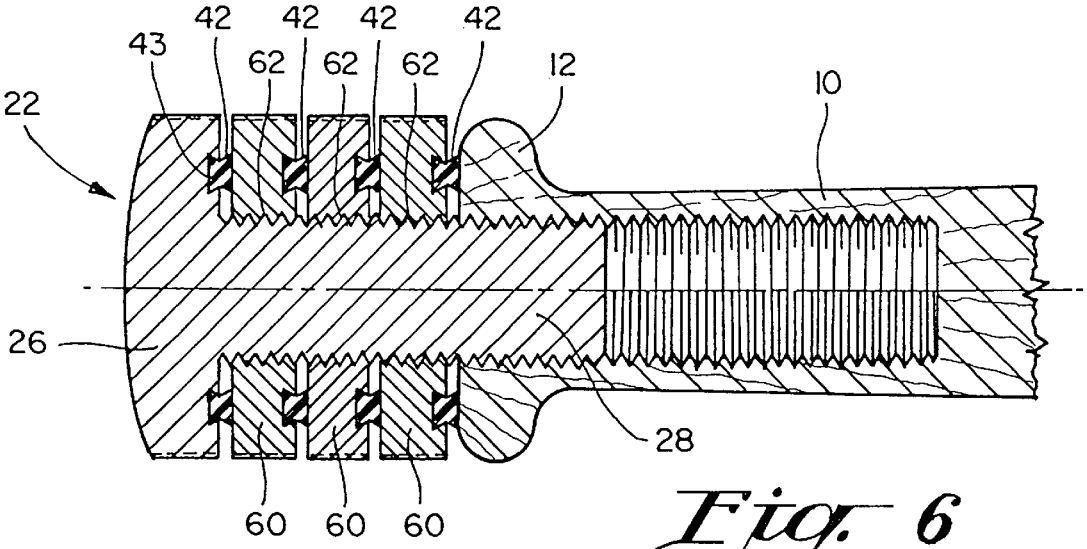
Fig. 6
Fig. 7
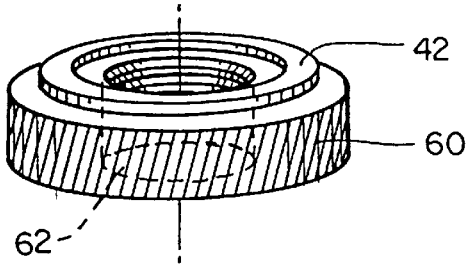

BASEBALL BAT AND PRACTICE DEVICE COMBINATION

This application is a continuation of application Ser. No. 08/580,985 filed on Jan. 3, 1996 U.S. Pat. No. 5,741,195.

BACKGROUND OF THE INVENTION

1. Field of the Invention

The present invention relates generally to baseball bats. More particularly, the present invention relates to a baseball bat adapted for use in combination with a practice device.

2. Description of the Prior Art

It is well known in the sporting world involving the game of baseball that a lot of practice is required for enabling a baseball player to develop a professional type of power swing for driving a baseball at the highest possible velocity, even though, in certain instances it may be desired to alter the swing for, so called, bunts, hits to the opposite field and the like. The present invention is concerned with a baseball batting training device suitable for use in practice by a baseball player to aid in developing a more accurate and powerful swing.

In the past, certain types of weights have been used on a bat, such as metal members, to assist a player in warming up before entry into the batter's box. Other attachments to a baseball bat for training purposes have been used to teach a batter how to make a proper swing when trying to hit a ball. Still other types of baseball batting training devices have embodied a permanently modified baseball bat that audibly signals the batter when he or she is swinging the bat properly.

For example, U.S. patent application Ser. No. 1,026,990 issued to Matson discloses a bat having a counterbalancing weight attached at one end. The Matson device utilizes a screw that is permanently secured to the bat for attachment of the weight thereto. Hence, the Matson device suffers from a problem common to other prior art that utilize modified baseball bats in that such devices cannot be used in a regulation baseball or softball game because the bat does not conform to official baseball bat regulations and standards.

Various baseball leagues and associations contain regulations and standards relating to size and shape characteristics of baseball bats. While these regulations and standards can differ with respect to specific weights and measurements, it is common to all such regulations that a baseball bat be formed of a single solid member. Therefore, modifications to a bat that attach other components, such as the screw in the Matson device, result in the bat being suitable only for practice or training purposes.

A more desirable baseball bat would be one that could be used in regulation baseball games and for practice allowing the user to develop a level of comfortableness with a single bat.

As will be described in greater detail hereinafter, the baseball bat and practice device of the present invention solves this problem and differs from those previously proposed and employs a number of novel features that render it highly advantageous over the prior art.

SUMMARY OF THE INVENTION

Accordingly, it is an object of this invention to provide a baseball bat which is sized and configured to conform to official baseball bat regulations and standards for use of the baseball bat in official baseball games as well as being capable for use in practice settings when attached in combination with a practice device.

Another object of this invention is to provide an easily attachable practice device which connects to the bat below the bat handle to produce a desirable leverage to aid a user in developing an improved swing.

Still another object of this invention is to provide a baseball bat and practice device which is inexpensive to manufacture.

To achieve the foregoing and other objectives, and in accordance with the present invention, a baseball bat is provided which is sized and configured to conform to official baseball bat regulations and standards for use of the baseball bat in official baseball games which is connectable in combination with a practice device for use in training. The baseball bat has a knob end disposed at one end of the bat adjacent to a cylindrically shaped handle portion of the bat. The knob end has a socket hole in axial alignment with the bat. The socket hole has internal threads. The socket hole and internal threads are formed integral with the knob end of the bat so that the bat conforms to official baseball bat regulations and standard when the baseball bat is used without the practice device. The practice device includes a weight structure having a weight sized for positioning in coaxial engagement with the knob end of the baseball bat, the weight structure having a bolt with external threads threadingly engageable with the internal threads of the socket hole to secure the practice device in fixed assembly with the knob end of the baseball bat for use in training.

Other objects, features and advantages of the invention will become more readily apparent upon reference to the following description when taken in conjunction with the accompanying drawings, which drawings illustrate several embodiments of the invention.

BRIEF DESCRIPTION OF THE DRAWINGS

FIG. 4 is a sectional view of an alternative embodiment of the baseball practice device having plurality of weight structures that are interconnectable for creating a desired weight;

FIG. 5 is a perspective view of a weight structure of the alternative embodiment of the baseball practice device shown in FIG. 4;

FIG. 6 is a sectional view of an alternative embodiment of the practice device having circular weight rings secured to a bolt of the weight structure;

FIG. 7 is a perspective view of a circular weight ring of the alternative embodiment of the baseball practice device of FIG. 6;

DETAILED DESCRIPTION OF THE PREFERRED EMBODIMENT

Figure 1:
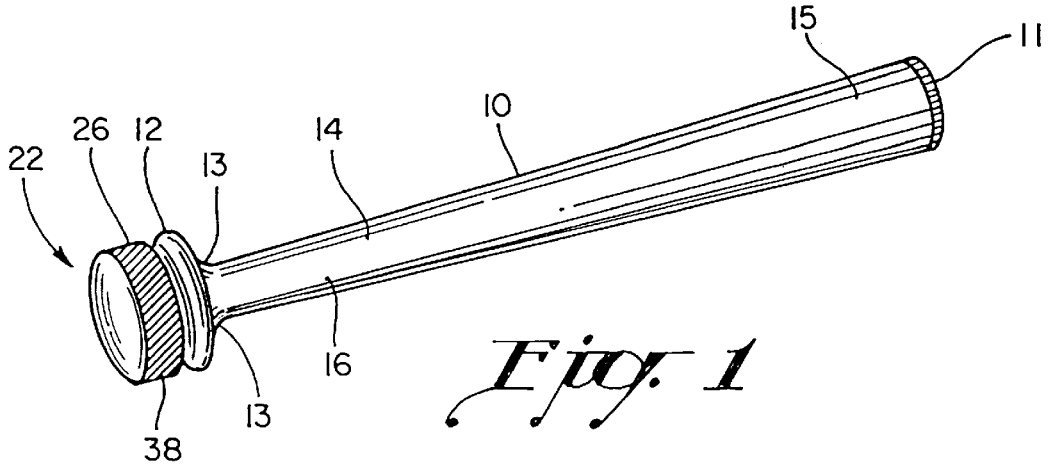
FIG. 1 is a perspective view of my new combination including a baseball bat and a practice device mountable on a knob of the bat.

Referring now to the drawings, a baseball bat 10 is provided and shown in FIG. 1 which is sized and configured to conform to official baseball bat regulations and standards for use of the baseball bat in official baseball games. To this degree, it is important to note that the bat 10 is formed of a single integral one-piece configuration. Preferably, the bat 10 is formed of non-wood material, such as aluminum or graphite.

Figure 2:
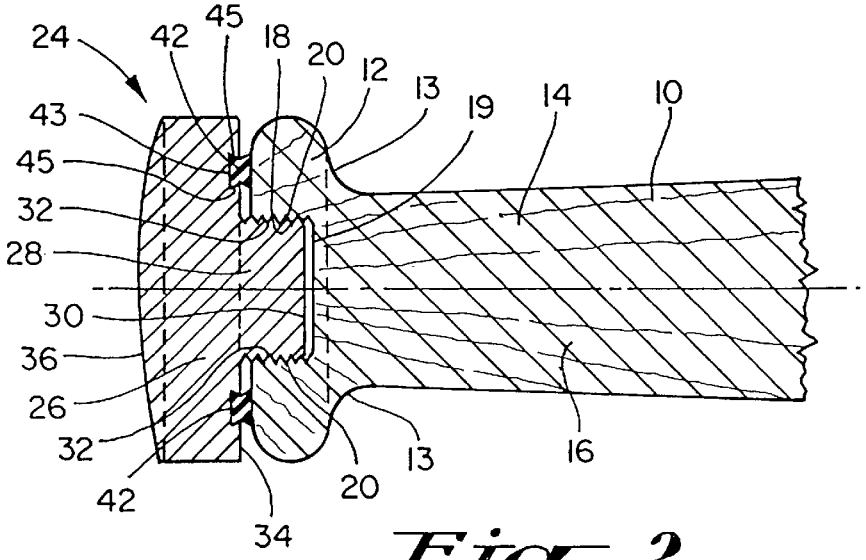
FIG. 2 is an enlarged sectional view of the baseball practice device shown in FIG. 1.

Referring to FIG. 2, the baseball bat 10 has a knob end 12 disposed at one end 14 of the bat 10 adjacent to a cylindrically shaped handle portion 16 of the bat 10. Typically, the knob end 12 is welded to the bat 10 at welds 13. It is common for an aluminum bat 10 to have a plastic end cap 11 attached at end 15 opposite the knob 15, as shown. It should be understood that the welded knob end 12 and plastic end cap 11 are parts of the bat 10, but the bat 10 is still considered to be formed of a single piece or member.

The knob end 12 has a socket hole 18 in axial alignment with the bat 10. The socket hole 18 is close ended having a bottom 19 and internal threads 20. The socket hole 18 and internal threads 20 are formed integral with the knob end 12 of the bat 10, so that the bat conforms to official baseball bat regulations and standards when the baseball bat 10 is used by itself without a weighted practice device 22. The bottom 19 of the socket hole 18 is formed by not extending it through the knob end 12 for the express purpose of eliminating the possibility of material being inserted into the socket hole 18. Therefore, during an official baseball game, an umpire can inspect the bat 10 to insure that the bat has not been tampered with.

Figure 8:
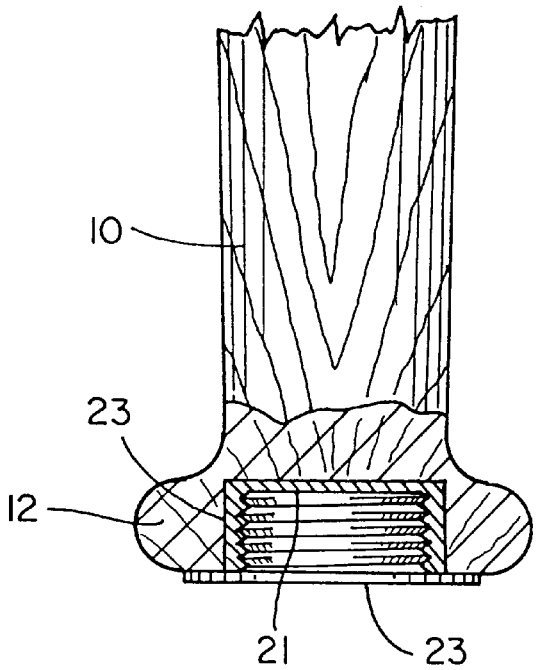
FIG. 8 is a sectional view of the knob end of the bat having a socket insert attached thereto.
Figure 9:
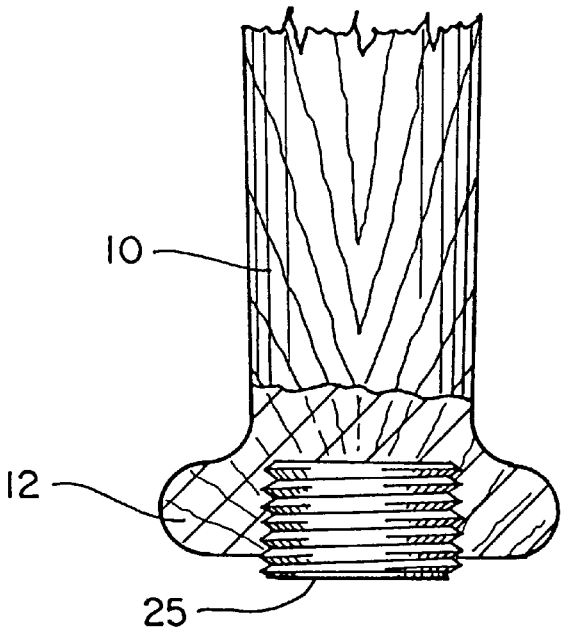
FIG. 9 is a sectional view of the knob end of the bat having a threaded insert.

A typical metal or non-wooden baseball bat is formed of aluminum or graphite. In this event, the internal threads 20 of the bat 10 are subject to damage or excessive wear over continued use due to the fragile nature of such material. Two approaches are presented to solve this problem. Referring to FIG. 8, an insert or cup-shaped socket insert 21 is provided formed of a more durable metal, such as stainless steel. The socket insert 21 is inserted and secured in a socket 23 of the knob end 12 of the bat by welding, brazing, or other conventional methods along a flange 23 of the insert 21. The socket insert 21 then becomes integrated with the knob end 12 and contains the socket hole 18 and internal threads 20. An alternative approach is shown in FIG. 9, where a cylindrically shaped threaded insert 25 is in threaded engagement with the internal threads 20 of the socket hole 18. The insert 25 is generally formed of a stainless steel material and has internal threads for receiving a bolt 28. It should be understood that a bat 10 formed of material having internal threads 20 of sufficient strength would not require either approach.

Referring to FIG. 2, the practice device 22 includes a weight structure 24 having a weight 26 sized for positioning in coaxial engagement with the knob end 12 of the baseball bat 10. The weight 26 is of a round circular configuration preferably having a diameter slightly smaller or the same as an outer diameter of the knob end 12 of the baseball bat 10. It is also possible for the weight 26 to have a diameter slightly larger than the outer diameter of the knob end 12, as a further alternative.

Preferably, the weight 26 is formed of material having a density greater than that of the baseball bat. It has been found that brass is preferable over lead because it is easier to machine. The weight structure 24 will typically have mass or weight in the range of one to forty-eight ounces. Excellent results can be obtained where the practice device has a weight of approximately fourteen to eighteen ounces for adult use and eight to twelve ounces for children's use.

The weight structure 24 has a bolt 28 with a bolt end 30 extending outwardly and in axial alignment with the weight 22. The external threads 32 of the bolt are threadingly engageable with the internal threads 20 of the socket hole 18 to secure the practice device 22 in fixed assembly with the knob end 12 of the baseball bat 10, as shown in FIG. 2.

The weight 26 has an upper surface 34, a lower surface 36, and a knurled outer circumferential portion or surface 38. The upper surface may be substantially flat or concave, as desired. The knurled surface 38 aids in providing improved grasping of the weight 26 by a users fingers. A gripping structure is attached to the upper surface 34 for engagement against the knob end 12 of the bat 10 to securely hold the weight 26 in coaxial engagement with the knob end 12 of the baseball bat 10 when the weight 26 is manually rotated to cause the external threads 32 to move axially of the socket hole 18 to tighten the engagement of the weight 26 against the knob end 12. In a preferred embodiment, the gripping structure comprises a circular gasket 42 secured to the upper surface 34 of the weight 26 by engaging a circular recess 43. Preferably, the recess 43 has a pair of inwardly sloping sidewalls 45 for pressingly engaging the gasket 42 to secure the gasket 42 in place.

Figure 3:
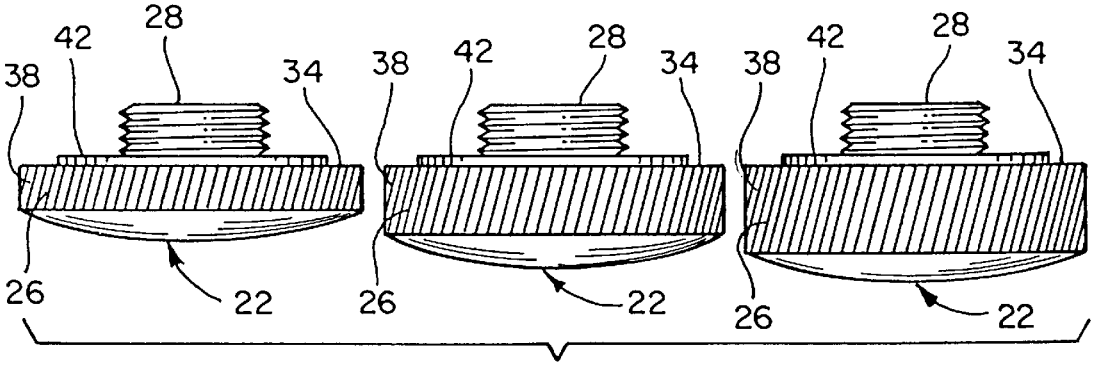
FIG. 3 is an enlarged perspective view of a set of practice devices having a range of weight.

To produce a range of different weights that may be applied to the bat 10, the weight 26 may be formed of varied thickness', as shown in FIG. 3. In an alternative embodiment of the practice device 22, shown in FIGS. 4 and 5, the lower surface 36 of the weight 26 has a second socket hole 44 having internal threads 46 for threaded engagement with external threads 47 of a second bolt 48 connected to a second weight structure 50 for positioning the second weight structure 50 in coaxial engagement with the weight 26. The second weight structure 50 is formed similar to the weight 26 to allow for attachment of yet a third weight structure 52 or additional similarly formed structures, as desired.

A second gripping structure, such as a gasket 42 as previously described, is attached to an upper surface 58 of the second weight structure 50 to securely hold the second weight structure in coaxial engagement with the weight structure 24 when the second weight structure 50 is manually rotated to cause the external threads 47 of the second bolt 48 to move axially of the second socket hole 44 to tighten the engagement of the second weight structure 50 against the weight structure 24. A gasket 42 is similarly attached to the third or additional weight structures.

In another alternative embodiment shown in FIGS. 6 and 7, circular weight rings 60 are provided to selectively increase the mass of the weight structure 24. Each circular weight ring 60 has a threaded bore 62 extending therethrough for threaded engagement with the external threads 32 of the bolt 28. To this extent, the bolt 28 and socket hole 18 would be increased in length and depth to accommodate the addition of one or more circular weight rings 60. A gaskets 42 as previously described is secured to the circular weight ring 60 to allow for tightened assembly of the structure.

When the practice device 22 is attached to the bat 10, the combination can be used during training sessions by a player to aid in improving his or her baseball batting swing, and ultimately aimed towards the end of increasing the velocity of the bat head at the point of impact with the ball. In a typical training procedure, the instructor will observe the player making practice swings, to attempt to instruct the player in proper techniques in the execution of the batting swing. In the course of this training procedure, the instructor may elect to have a ball put on a practice tee, throw the ball vertically upward, or batting practice, and have the player strike the ball with the device on the bat.

The foregoing discussion discloses and describes merely exemplary embodiments of the present invention. One skilled in the art will readily recognize from such discussion, and from the accompanying drawings and claims, that various changes, modifications, and variations can be made without departing from the spirit and scope of the invention as defined in the following claims.

I claim:

1. A baseball bat sized and configured for use in a baseball game by itself and in combination with a practice device for use in training, comprising in combination: the baseball bat having a knob end disposed at one end of the bat adjacent to a cylindrically shaped handle portion of the bat and an insert, the knob end having an aperture sized for receiving the insert, the insert being connected to the knob end, the insert defining a socket hole, the practice device including a weight structure having a weight sized for positioning in coaxial engagement with the knob end of the baseball bat, the weight having a mass in the range of one to forty-eight ounces, the weight structure having connection means projecting outwardly from the weight structure for disengageable connection within the socket hole to secure the practice device in fixed position with the knob end of the baseball bat for use in training, the weight structure and connecting means being inseparable with one another, the knob end of the baseball bat being free of protuberances for use of the baseball bat in the baseball game without the practice device.

2. The combination of claim 1, wherein the weight is formed of material having a density greater than that of the baseball bat.

3. The combination of claim 1, wherein the insert is threaded for threaded engagement with the knob end of the baseball bat.

4. The combination of claim 3, wherein the insert is formed of metal.

5. The combination of claim 1, wherein an outer circumferential portion of the weight is formed of a knurled surface.

6. The combination of claim 1, wherein the insert is cup-shaped.

7. The combination of claim 1, wherein the insert is cylindrically shaped.

8. A baseball bat sized and configured for use in a baseball game by itself and in combination with a practice device for use in training, comprising in combination: the baseball bat having a knob end disposed at one end of the bat adjacent to a cylindrically shaped handle portion of the bat and an insert, the knob end having an aperture sized for receiving the insert, the insert being connected to the knob end, the insert defining a socket hole, the socket hole having internal threads and a bottom, the practice device including a weight structure having a weight sized for positioning in coaxial engagement with the knob end of the baseball bat, the weight having a mass in the range of one to forty-eight ounces, a circular gasket secured to an upper surface of the weight structure, the weight structure having a bolt with external threads threadingly engageable with the internal threads of the socket hole to secure the practice device in fixed assembly with the knob end of the baseball bat for use in training, the weight structure and bolt being inseparable with one another, the knob end of the baseball bat being free of protuberances for use of the baseball bat in the baseball game without the practice device.

9. The combination of claim 8, wherein the weight is formed of material having a density greater than that of the baseball bat.

10. The combination of claim 9, wherein the insert is threaded for threaded engagement with the knob end of the baseball bat.

11. The combination of claim 10, wherein the insert is formed of metal.

12. The combination of claim 10, wherein an outer circumferential portion of the weight is formed of a knurled surface.

13. The combination of claim 8, wherein the insert is cup-shaped.

14. The combination of claim 8, wherein the insert is cylindrically shaped.

* * * * *